US008611769B2

(12) United States Patent
Burry et al.

(10) Patent No.: US 8,611,769 B2
(45) Date of Patent: Dec. 17, 2013

(54) METHOD AND SYSTEM FOR TROUBLESHOOTING CHARGING AND PHOTORECEPTOR FAILURE MODES ASSOCIATED WITH A XEROGRAPHIC PROCESS

(75) Inventors: Aaron Michael Burry, Ontario, NY (US); Surendar Jeyadev, Rochester, NY (US); Palghat S. Ramesh, Pittsford, NY (US); Eric Scott Hamby, Webster, NY (US); Vladimir Kozitsky, Rochester, NY (US); Gary Walker Skinner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 64 days.

(21) Appl. No.: 13/302,332

(22) Filed: Nov. 22, 2011

(65) Prior Publication Data

US 2013/0129365 A1 May 23, 2013

(51) Int. Cl.
*G03G 5/00* (2006.01)

(52) U.S. Cl.
USPC ..... 399/31; 399/48; 399/50; 399/128

(58) Field of Classification Search
CPC ..... G03G 5/00
USPC ..... 324/452; 399/9–37, 48, 50, 128; 702/64
See application file for complete search history.

(56) References Cited

U.S. PATENT DOCUMENTS

| | | | | |
|---|---|---|---|---|
| 4,786,858 | A | 11/1988 | Haas et al. | |
| 5,119,131 | A | 6/1992 | Paolini et al. | |
| 5,191,293 | A * | 3/1993 | Kreckel | 324/452 |
| 5,212,451 | A | 5/1993 | Werner, Jr. | |
| 5,270,660 | A | 12/1993 | Werner, Jr. et al. | |
| 5,323,115 | A | 6/1994 | Werner, Jr. | |
| 5,438,354 | A | 8/1995 | Genovese | |
| 5,903,796 | A | 5/1999 | Budnik et al. | |
| 5,946,521 | A * | 8/1999 | Budnik et al. | 399/24 |
| 6,611,665 | B2 * | 8/2003 | DiRubio et al. | 399/9 |
| 6,806,717 | B2 | 10/2004 | Werner, Jr. et al. | |
| 7,324,766 | B2 | 1/2008 | Zona | |
| 7,747,184 | B2 * | 6/2010 | DiRubio et al. | 399/48 |
| 7,903,269 | B2 | 3/2011 | Nakagawa et al. | |
| 7,903,988 | B2 | 3/2011 | Ozaki et al. | |
| 2006/0222381 | A1 * | 10/2006 | Moriya et al. | 399/26 |
| 2010/0329701 | A1 * | 12/2010 | Zona et al. | 399/26 |
| 2011/0052228 | A1 * | 3/2011 | Kozitsky et al. | 399/49 |
| 2011/0246107 | A1 * | 10/2011 | Burry et al. | 702/64 |
| 2012/0183310 | A1 * | 7/2012 | Asano et al. | 399/26 |
| 2012/0294631 | A1 * | 11/2012 | Burry et al. | 399/15 |

FOREIGN PATENT DOCUMENTS

| | | | | |
|---|---|---|---|---|
| JP | 1993-209914 | * | 8/1993 | G03G 5/00 |
| JP | 2006-330722 | * | 12/2006 | G03G 21/00 |
| JP | 2011-048366 | * | 3/2011 | G03G 15/00 |

* cited by examiner

*Primary Examiner* — Clayton E LaBalle
*Assistant Examiner* — Kevin Butler
(74) *Attorney, Agent, or Firm* — Fay Sharpe LLP

(57) ABSTRACT

This disclosure provides methods and systems for troubleshooting charging and photoreceptor failure modes associated with a xerographic process. Specifically, according to an exemplary method the photoreceptor decay behavior, with and without the effects of depletion, are quantified and used to determine a performance state of one or more of the charging stations and the photoreceptor surface.

20 Claims, 5 Drawing Sheets

METHOD AND SYSTEM FOR TROUBLESHOOTING CHARGING AND PHOTORECEPTOR FAILURE MODES ASSOCIATED WITH A XEROGRAPHIC PROCESS

BACKGROUND

This disclosure relates to methods and systems for troubleshooting charging and photoreception failure modes associated with a xerographic process.

An electrophotographic, or xerographic, image printing system employs an image bearing surface, such as a photoreceptor drum or belt, which is charged to a substantially uniform potential so as to sensitize the surface thereof. The charged portion of the image bearing surface is exposed to a light image of an original document being reproduced. Exposure of the charged image bearing surface selectively dissipates the charge thereon in the irradiated areas to record an electrostatic latent image on the image bearing surface corresponding to the image contained within the original document. The location of the electrical charge forming the latent image is usually optically controlled. More specifically, in a digital xerographic system, the formation of the latent image is controlled by a raster output scanning device, usually a laser or LED source.

After the electrostatic latent image is recorded on the image bearing surface, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the image bearing surface. After the electrostatic latent image is developed with the toner particles, the toner powder image is transferred to a media, such as sheets, paper or other substrate sheets, using pressure and heat to fuse the toner image to the media to form a print.

An image printing system generally has two important dimensions: a process (or a slow scan) direction and a cross-process (or a fast scan) direction. The direction in which an image bearing surface moves is referred to as the process (or the slow scan) direction, and the direction perpendicular to the process (or the slow scan) direction is referred to as the cross-process (or the fast scan) direction.

Electrophotographic image printing systems may produce color prints using a plurality of stations. Each station has a charging device for charging the image bearing surface, an exposing device for selectively illuminating the charged portions of the image bearing surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multicolor powder image is subsequently transferred to a media. The transferred multicolor image is then permanently fused to the media forming the color print.

In a xerographic system, two of the most common failure sources are the charge device and the photoreceptor. Unfortunately, failure of either of these two components often produces identical failure mode effects (observables). Thus, it is often very difficult to quickly resolve which of these two components is the source of an observed failure mode effect. Such ambiguity leads to issues in properly diagnosing and fixing customer machines in the field and therefore increased downtime, increased parts usage (swapping in new components to try to resolve the issue), and increased on-site time for field service technicians.

INCORPORATION BY REFERENCE

U.S. Patent Application Publication No. 2011/0052228, by Kozitsky et al., published Mar. 3, 2011 and entitled "METHOD AND SYSTEM FOR BANDING COMPENSATION USING ELECTROSTATIC VOLTMETER BASED SENSING";

U.S. Pat. No. 4,786,858, by Haas et al, issued Nov. 22, 1988 and entitled "LIQUID CRYSTAL ELECTROSTATIC VOLTMETER";

U.S. Pat. No. 5,119,131, by Paolini et al., issued Jun. 2, 1992, and entitled "ELECTROSTATIC VOLTMETER (ESV) ZERO OFFSET ADJUSTMENT";

U.S. Pat. No. 5,212,451, by Werner, Jr., issued May 18, 1993, and entitled "SINGLE BALANCED BEAM ELECTROSTATIC VOLTMETER MODULATOR";

U.S. Pat. No. 5,270,660, by Werner, Jr. et al., issued Dec. 14, 1993 and entitled "ELECTROSTATIC VOLTMETER EMPLOYING HIGH VOLTAGE INTEGRATED CIRCUIT DEVICES";

U.S. Pat. No. 5,323,115, by Werner, Jr., issued Jun. 21, 1994 and entitled "ELECTROSTATIC VOLTMETER PRODUCING A LOW VOLTAGE OUTPUT";

U.S. Pat. No. 5,438,354, by Genovese, issued Aug. 1, 1995, and entitled "START-OF-SCAN AND END-OF-SCAN OPTICAL ELEMENT FOR A RASTER OUTPUT SCANNER IN AN ELECTROPHOTOGRAPHIC PRINTER";

U.S. Pat. No. 6,611,665, by DiRubio et al., issued Aug. 26, 2003 and entitled "METHOD AND APPARATUS USING A BIASED TRANSFER ROLL AS A DYNAMIC ELECTROSTATIC VOLTMETER FOR SYSTEM DIAGNOSTICS AND CLOSED LOOP PROCESS CONTROLS";

U.S. Pat. No. 6,806,717, by Werner, Jr. et al., issued Oct. 19, 2004 and entitled "SPACING COMPENSATING ELECTROSTATIC VOLTMETER";

U.S. Pat. No. 7,324,766, by Zona, issued Jan. 29, 2008 and entitled "CROSS-PROCESS CHARGE UNIFORMITY SCANNER";

U.S. Pat. No. 7,747,184, by DiRubio et al., issued Jun. 29, 2010 and entitled "METHOD OF USING BIASED CHARGING/TRANSFER ROLLER AS IN-SITU VOLTMETER AND PHOTORECEPTOR THICKNESS DETECTOR AND METHOD OF ADJUSTING XEROGRAPHIC PROCESS WITH RESULTS"; and U.S. Pat. No. 7,903,988, by Ozaki et al., issued Mar. 8, 2011 and entitled "IMAGE FORMING APPARATUS CAPABLE OF DETECTING GHOST IMAGE," are all incorporated herein by reference in their entirety.

BRIEF DESCRIPTION

In one embodiment of this disclosure, described is a method of performing diagnostics on a xerographic printing system to determine a failure mode associated with the xerographic printing system, the printing system including a photoreceptor surface, a charging station, a light exposure station, a developer station, an image transfer station, an eraser station, and photoreceptor surface voltage sensor, the method comprising a) the charging station charging the photoreceptor surface for two or more revolutions while the light exposure station, the developer station and eraser station are in a state which does not substantially affect the charge state of the photoreceptor surface; b) stopping the charging of the photoreceptor surface and allowing the photoreceptor surface to revolve while monitoring the voltage of the photoreceptor surface; c) the charging station charging the photoreceptor for a single revolution after the voltage of the photoreceptor surface decays to $V_{residual}$; d) monitoring the voltage of the photoreceptor for two or more revolutions to determine the $V_{opc}$ decay behavior of the photoreceptor surface without depletion; e) erasing the photoreceptor surface for one revolution while the charging station, the light exposure station and the developer station are in a state which does not substantially affect the charge state of the photoreceptor surface; f) charging the photoreceptor surface for one revolution while the light exposure station, the developer station and the erase station are in a state which does not substantially affect the charge state of the photoreceptor surface; g) monitoring the voltage of the photoreceptor for two or more revolutions to determine $V_{opc}$ decay behavior of the photoreceptor surface with depletion; h) comparing the $V_{opc}$ decay behavior determined in step d) with the $V_{opc}$ decay behavior determined in step g) and determining the performance state of one or more of the charging station and the photoreceptor surface based on the comparison; and i) performing one or more of communicating and storing the performance state of one or more of the charger and the photoreceptor surface.

In another embodiment of this disclosure, described is a xerographic printing system comprising a photoreceptor surface; a charging station; a light exposure station; a developer station; an image transfer station; a photoreceptor surface voltage sensor; and a controller operatively associated with the photoreceptor surface, charging station, light exposure station, image transfer station and photoreceptor surface voltage sensor, the controller configured to perform the method comprising a) the charging station charging the photoreceptor surface for two or more revolutions while the light exposure station, the developer station and eraser station are in a state which does not substantially affect the charge state of the photoreceptor surface; b) stopping the charging of the photoreceptor surface and allowing the photoreceptor surface to revolve while monitoring the voltage of the photoreceptor surface; c) the charging station charging the photoreceptor for a single revolution after the voltage of the photoreceptor surface decays to $V_{residual}$; d) monitoring the voltage of the photoreceptor for two or more revolutions to determine the $V_{opc}$ decay behavior of the photoreceptor surface without depletion; e) erasing the photoreceptor surface for one revolution while the charging station, the light exposure station and the developer station are in a state which does not substantially affect the charge state of the photoreceptor surface; f) charging the photoreceptor surface for one revolution while the light exposure station, the developer station and the erase station are in a state which does not substantially affect the charge state of the photoreceptor surface; g) monitoring the voltage of the photoreceptor for two or more revolutions to determine $V_{opc}$ decay behavior of the photoreceptor surface with depletion; h) comparing the $V_{opc}$ decay behavior determined in step d) with the $V_{opc}$ decay behavior determined in step g) and determining the performance state of one or more of the charging station and the photoreceptor surface based on the comparison; and i) performing one or more of communicating and storing the performance state of one or more of the charger and the photoreceptor surface.

In still another embodiment of this disclosure, described is A method of performing diagnostics on a xerographic printing system in a diagnostic mode, independent from a nominal printing mode, to determine a failure mode associated with the xerographic printing system, the printing system including a photoreceptor surface, a charging station, a light exposure station, a developer station, an image transfer station, an eraser station, and photoreceptor surface voltage sensor, the method comprising the xerographic printing system running in diagnostic mode and executing the method comprising a) the charging station charging the photoreceptor surface for two or more revolutions while the light exposure station, the developer station and eraser station are in a state which does not substantially affect the charge state of the photoreceptor surface; b) stopping the charging of the photoreceptor surface and allowing the photoreceptor surface to revolve while monitoring the voltage of the photoreceptor surface; c) the charging station charging the photoreceptor for a single revolution after the voltage of the photoreceptor surface decays to $V_{residual}$; d) monitoring the voltage of the photoreceptor for two or more revolutions to determine the $V_o$, decay behavior of the photoreceptor surface without depletion; e) erasing the photoreceptor surface for one revolution while the charging station, the light exposure station and the developer station are in a state which does not substantially affect the charge state of the photoreceptor surface; f) charging the photoreceptor surface for one revolution while the light exposure station, the developer station and the erase station are in a state which does not substantially affect the charge state of the photoreceptor surface; g) monitoring the voltage of the photoreceptor for two or more revolutions to determine $V_{opc}$ decay behavior of the photoreceptor surface with depletion; h) comparing the $V_{opc}$ decay behavior determined in step d) with the $V_{opc}$ decay behavior determined in step g) and determining the performance state of one or more of the charging station and the photoreceptor surface based on the comparison; and i) performing one or more of communicating and storing the performance state of one or more of the charger and the photoreceptor surface; and the xerographic printing system exiting the diagnostic mode.

DETAILED DESCRIPTION

This disclosure provides methods and systems for resolving the ambiguity between charge device and photoreceptor induced failure modes for measured/observed behaviors associated with a xerographic process. The approach uses in-situ measurements of the charge decay behavior of a photoreceptor under different conditions to isolate the contributions from two dominant photoreceptor failure modes—more specifically, depletion and increased dark decay. Methods are also disclosed for using the results of this analysis to inform diagnostic and/or prognostic capabilities. The method isolates which of the two items is failing and can detect potential failure prior to a complete failure to avoid down time (prognostic).

Figure 1:
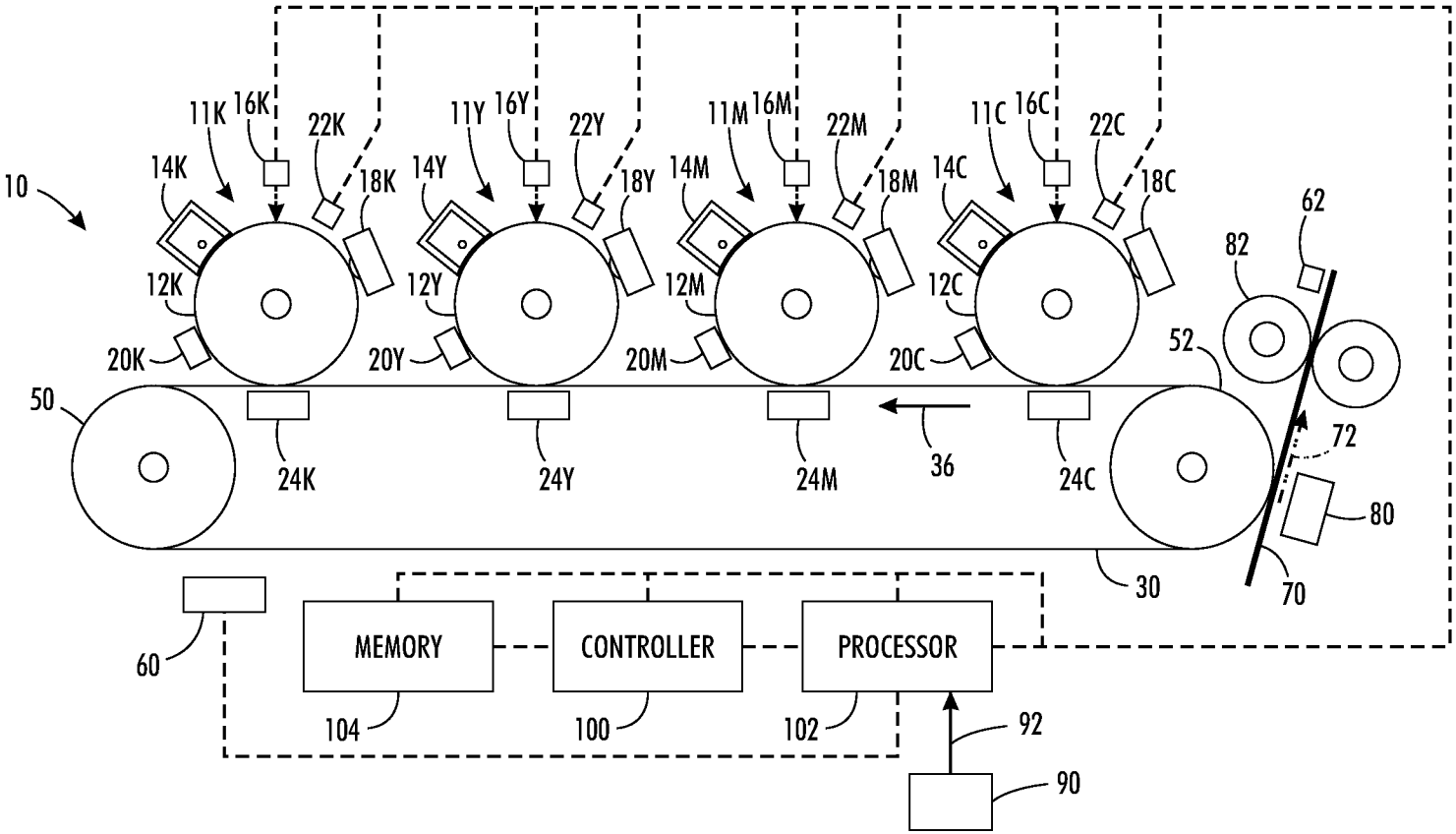
FIG. 1 is a schematic of a four color xerographic process according to an exemplary embodiment of this disclosure.

FIG. 1 illustrates one embodiment of a multicolor image printing system 10 incorporating an exemplary embodiment of this disclosure. Specifically, there is shown an "intermediate-belt-transfer" xerographic color image printing system, in which successive primary-color (e.g., C, M, Y, K) images are accumulated on image bearing surface 12 C, 12 M, 12 Y, and 12 K. Each image bearing surface 12 C, 12 M, 12 Y, and 12 K in turn transfers the images to an intermediate transfer member 30. However, it should be appreciated that any image printing machine, such as monochrome machines using any technology, machines that print on photosensitive substrates, xerographic machines with multiple photoreceptors, "image-on-image" xerographic color image printing systems (e.g., U.S. Pat. No. 7,177,585, herein incorporated by reference in its entirety), Tightly Integrated Parallel Printing (TIPP) systems (e.g. U.S. Pat. Nos. 7,024,152 and 7,136,616, each of which herein incorporated by reference in its entirety), or liquid ink electrophotographic machines, may utilize the present disclosure as well.

In an exemplary embodiment, the image printing system 10 includes marking stations 11 C, 11 M, 11 Y, and 11 K (collectively referred to as 11) arranged in series for successive color separations (e.g., C, M, Y, and K). Each print station 11 includes an image bearing surface with a charging device, an exposing device, a developer device, an ESV (Electrostatic Voltmeter) and a cleaning device disposed around its periphery. For example, printing station 11 C includes image bearing surface 12 C, charging device 14 C, exposing device 16 C, developer device 18 C, ESV 22 C, transfer device 24 C, and cleaning device 20 C. Transfer device 24 C may be a Bias Transfer Roll, as shown in FIG. 1 of U.S. Pat. No. 5,321,476, herein incorporated by reference in its entirety. For successive color separations, there is provided equivalent elements 11 M, 12 M, 14 M, 16 M, 18 M, 20 M, 22 M, 24 M (for magenta), 11 Y, 12 Y, 14 Y, 16 Y, 18 Y, 20 Y, 22 Y, 24 Y (for yellow), and 11 K, 12 K, 14 K, 16 K, 18 K, 20 K, 22 K, 24 K (for black).

In one embodiment, a single color toner image formed on first image bearing surface 12 C is transferred to intermediate transfer member 30 by first transfer device 24 C. Intermediate transfer member 30 is wrapped around rollers 50, 52 which are driven to move intermediate transfer member 30 in the direction of arrow 36. The successive color separations are built up in a superimposed manner on the surface of the intermediate transfer member 30, and then the image is transferred from the intermediate transfer member (e.g., at transfer station 80) to an image accumulation surface 70, such as a document, to form a printed image on the document. The image is then fused to document 70 by fuser 82.

The exposing devices 16 C, 16 M, 16 Y, and 16 K may be one or more Raster Output Scanner (ROS) to expose the charged portions of the image bearing surface 12 C, 12 M, 12 Y, and 12 K to record an electrostatic latent image on the image bearing surface 12 C, 12 M, 12 Y, and 12 K. U.S. Pat. No. 5,438,354, the entirety of which is incorporated herein by reference, provides one example of a ROS system.

In one aspect of the embodiment, ESVs 22 C, 22 M, 22 Y, and 22 K (collectively referred to as 22) are configured to sense a charge density or voltage on the surface of image bearing surfaces 12 C, 12 M, 12 Y, and 12 K, (collectively referred to as 12) respectively. For examples of ESVs, see, e.g., U.S. Pat. Nos. 6,806,717, 5,270,660; 5,119,131; and 4,786,858, each of which herein incorporated by reference in its entirety. Preferably, ESVs 22 C, 22 M, 22 Y, and 22 K are located after exposing devices 16 C, 16 M, 16 Y, and 16 K, respectively, and before developer devices 18 C, 18 M, 18 Y, and 18 K, respectively. It should be appreciated that an array of ESVs may be arranged in the cross-process direction to enable measurement of amplitude variation across the cross-process direction. It should also be appreciated that multiple ESVs may be mounted around the photoreceptor. For embodiments that employ multiple ESVs mounted around the photoreceptor, the same charged-and-exposed area on the photoreceptor may be measured by multiple ESVs.

The readings of ESVs 22 are sent to the processor 102. Processor 102 is configured to generate data relating to the amplitude voltage readings of ESVs 22.

Referring back to FIG. 1, processor 102 may be an image processing system (IPS) that may incorporate what is known in the art as a digital front end (DFE). For example, processor 102 may receive image data representing an image to be printed. The processor 102 may process the received image data to produce print ready data that is supplied to an output device, such as marking engines 11 C, 11 M, 11 Y and 11 K. Processor 102 may receive image data 92 from an input device (e.g., an input scanner) 90, which captures an image from an original document, a computer, a network, or any similar or equivalent image input terminal in communication with processor 102.

Developing procedures to quickly and accurately diagnose the cause of an observed failure mode in a printer is critical to both customer satisfaction and printing system fleet maintenance costs. As providers drive towards providing more remote/customer solutions, and therefore substantially reduced service costs, tools are required for the welcome center and/or the customer at the machine that will facilitate rapid identification of the correct failed component. In the past, service organizations have developed standard procedures and/or rules of thumb that guide service technicians and customer decision making for diagnostics. Unfortunately, in many cases a single observed failure mode effect can be caused by a number of different failed components. This often results in remaining ambiguity even after the general guidelines or rules of thumb are applied.

For example, a standard service procedure is to examine key locations within the non-volatile memory (NVM) of a printer to evaluate the health state of the machine. In fact, service technicians often apply a set of simple rules to these measured NVM values as the first step in a diagnostic session. For systems with non-contact scorotron charging and an ESV sensor, one of the NVM rules looks specifically at the required grid potential applied to the scorotron relative to the measured photoreceptor potential after charging. Theoretically, the potential difference between these two values should be relatively small. Thus, there is a simple diagnostic rule that highlights a problem in the system if this potential difference grows too large (typically larger than around 40 Volts). Unfortunately, the conclusions that can be drawn from this condition are still ambiguous—the problem could be either the charge device or the photoreceptor. This is typical of other known methods for identifying failure modes in a xerographic system—the intimate relationship between the charge device and the photoreceptor in producing the required xerographic voltages makes it extremely difficult to identify the underlying failure mode source. This is particularly important in systems with separate CRUs (Customer Replaceable Units) for the charge device and photoreceptor. Here, correctly identifying the failed component is critical to maintaining low post-sale maintenance costs by avoiding unnecessary part swapping.

This disclosure provides a method and system for resolving the ambiguity between the charge device and photoreceptor induced failure modes for measured/observed behaviors. The approach uses in-situ measurements of the charge decay behavior of the photoreceptor under different conditions to isolate the contributions from two dominant photoreceptor failure modes—depletion and increased dark decay. Methods are also disclosed for using the results of this analysis to inform diagnostic and/or prognostic capabilities.

In systems with non-contact scorotron charging, measurements of the potential difference between the applied grid voltage ($V_{grid}$) and the resulting photoreceptor voltage ($V_{high}$) are often used as one indicator of the health state of the xerographic system. If this potential difference grows too large, it is indicative of one of the following primary failure sources:

(1) Insufficient charging output capability from the charge device. This is most often caused by contamination of the grid or the wires for scorotron based charging systems.

(2) Inability of the photoreceptor to maintain the charge delivered by the charging device. This is typically caused by one of the following:

(2.1) An increase in the amount of dark decay (i.e. an increase in the rate of decay of the photoreceptor potential) that is occurring post charging due to electrical and/or mechanical aging of the photoreceptor material.

(2.2) Depletion occurring within the photoreceptor. This results from excess trapped holes within the photoreceptor that lead to unwanted electron-hole pair recombination, thereby reducing the photoreceptor potential.

The standard health state technique for comparing $V_{grid}$ and $V_{high}$ can be used in the field to help quickly narrow down the set of likely failure sources in a xerographic printer. However, it doesn't completely resolve the ambiguity inherent in the system. Once again, because of the intimate relationship between the photoreceptor and the charge device in generating and maintaining the desired $V_{high}$ level, it remains difficult to isolate the failure mode source. As indicated above, a large delta between $V_{grid}$ and $V_{high}$ could result from the charge device providing an insufficient amount of charging output for a given actuator ($V_{grid}$) setting, or it could be that the photoreceptor is not properly maintaining the charge that is delivered to its surface, due to either depletion or dark decay.

Resolving this inherent ambiguity between the photoreceptor and charge device failure modes is critical to enabling improvements in diagnostic methods, creating more narrowly focused health state metrics, and enabling reductions in overall post-launch maintenance costs for printing system providers.

As outlined above, it can be challenging to quantify the individual contributions from both photoreceptor and charge device to the overall photoreceptor potential $V_{opc}$ as measured after charging. The present disclosure provides methods and systems based on a methodology for isolating the two predominant photoreceptor contributions, i.e. dark decay and depletion, using measurements of the multi-pass charging and decay behavior. With two of the three fundamental contributors determined, i.e. depletion and dark-decay, the remaining unexplained behavior can be assigned to the charging device.

The disclosed methodology includes several steps which are outlined in detail below.

Measuring the Contribution from Dark-Decay

The dark-decay behavior of a photoreceptor can be measured in-situ across multiple revolutions. However, it is important that the unforced decay response is isolated from the effects of depletion. Depletion is caused by an excess of trapped holes within the P/R that cause unwanted electron-hole pair recombination, thereby reducing the potential on the photoreceptor after charging. The amount of excess trapped holes is typically a strong function of the erase power applied to the P/R. Thus, if erase is turned off, the impact of depletion is minimal beyond the first couple of subsequent P/R revolutions. During these initial revolutions, the decay rate of the photoreceptor potential will typically be much higher than for all subsequent revolutions. In effect, once the undesired electron-hole pair recombination has occurred, the photoreceptor resumes its standard dark-decay behavior.

Figure 2:
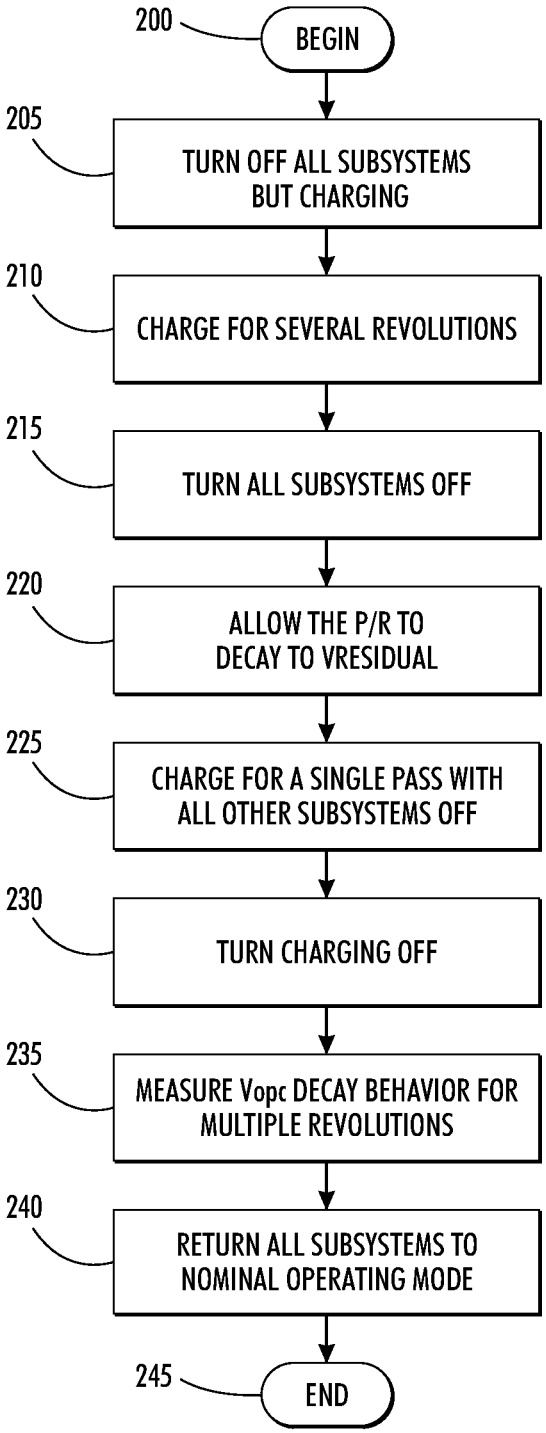
FIG. 2 is a flow chart of a method measuring the dark-decay behavior of a P/R (Photo Receptor) according to an exemplary embodiment of this disclosure.

So, in order to measure the dark-decay characteristic of the photoreceptor with minimal effects from depletion, one can simply turn off erase and all other xerographic subsystems, except charging, for several P/R revolutions. This provides sufficient time for the excess trapped holes to recombine. At this point, charging is turned off and the P/R is allowed to decay to its residual potential ($V_{residual}$). This is important as it ensures that the charge device is forced to charge all the way from $V_{residual}$ to $V_{high}$, just as it would if the erase lamp were turned on during normal mode. Next, only the charge device is turned on for a single P/R revolution. Once the charging device is turned off, the photoreceptor potential is then measured for multiple revolutions—from the initial charging revolution through a number of subsequent revolutions. The measurements obtained for these subsequent revolutions represent the dark-decay behavior of the P/R. A flowchart illustrating the required sequence of operations is provided in FIG. 2.

Initially, the process begins 200.

Next 205, all subsystems, except charging, are turned off.

Next 210, the P/R belt/drum is charged for several revolutions.

Next 215, all subsystems associated with charging are turned off.

Next 220, the P/R belt/drum is allowed to decay to $V_{residual}$.

Next 225, the P/R belt/drum is charged by the charging device for single pass with all other subsystems off.

Next 230, the charging device is turned off.

Next 235, $V_{opc}$ decay behavior of the P/R belt/drum is measured for several revolutions.

Next 240, all subsystems are returned to nominal operating modes and the process ends 245.

Figure 3:
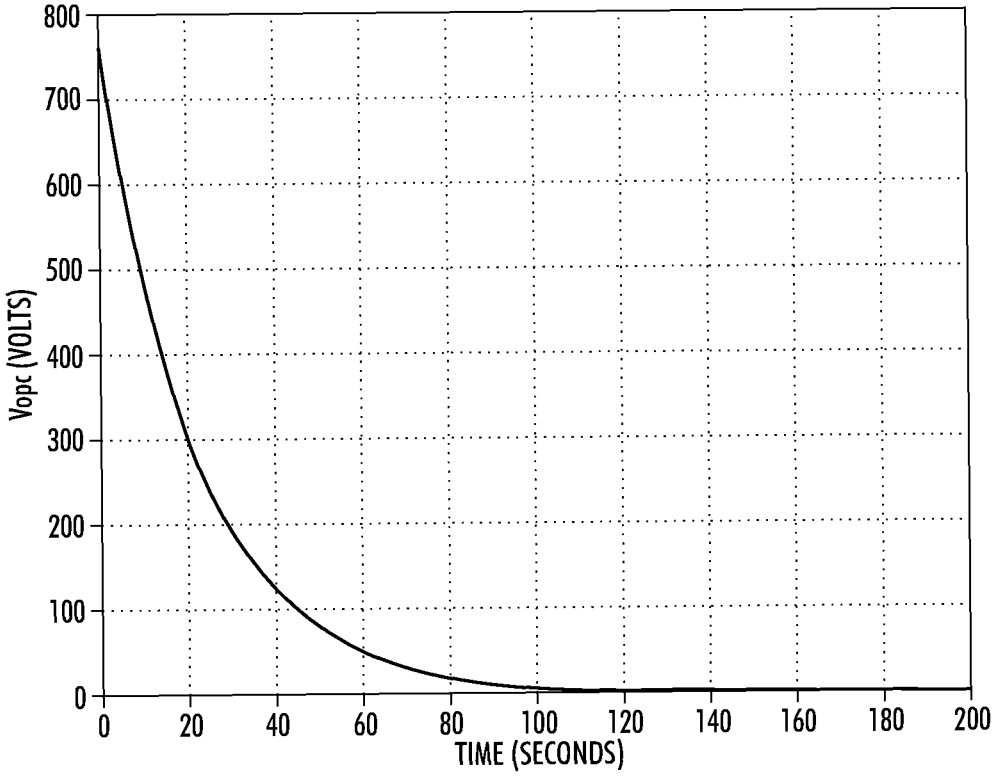
FIG. 3 is an exemplary measured Dark Decay Curve associated with a P/R according to an exemplary embodiment of this disclosure.

Standard techniques involve fitting either a power law or exponential decay model to this data. Doing so facilitates comparisons of the dark decay behavior of the photoreceptor under different conditions based on the parameters of the fit model. For the exponential decay model, the key parameters are the initial voltage V0, the decay rate $\alpha$, and the residual voltage $V_{residual}$. A sample dark decay curve that was fit from experimental data measured in this multi-revolution fashion is shown in FIG. 3.

Note that in many systems, the required photoreceptor potential measurements can be made with an existing in-situ electrostatic voltmeter (ESV). However, not all xerographic printers have ESVs as standard sensors, mostly due to the cost. In such cases, it is still possible to obtain the data required for the present method using a biased transfer roll (BTR) as disclosed in U.S. Pat. No. 6,611,665 (DiRubio et al.).

Isolating the Contribution from Depletion

As previously discussed, if erase is turned off, the impact of depletion is minimal beyond the first couple of subsequent P/R revolutions. During these initial revolutions, the decay rate of the photoreceptor potential will typically be much higher than for all subsequent revolutions. In effect, once the undesired electron-hole pair recombination has occurred, the photoreceptor resumes its standard dark-decay behavior.

Figure 4:
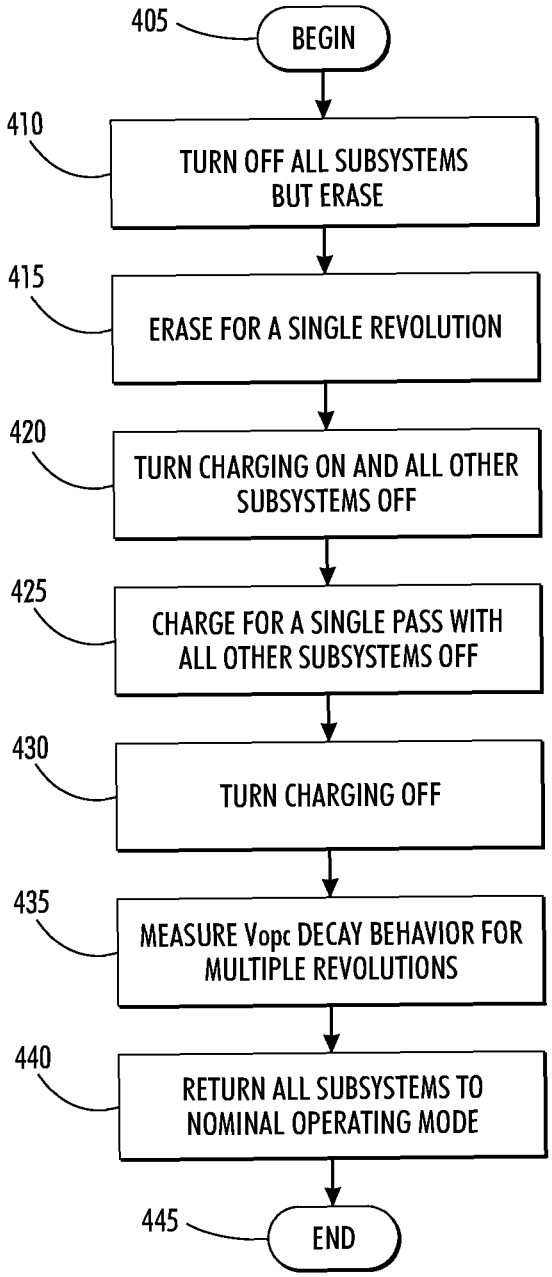
FIG. 4 is a flow chart of a method of measuring the dark-decay, with depletion, behavior of a P/R according to an exemplary embodiment of this disclosure.

The procedure presented above provides a measurement of the dark-decay response with minimal contribution from depletion. In order to quantify the contribution from depletion, a second set of measurements is obtained. Here, the photoreceptor is first erased completely by turning off all pertinent subsystems except erase, i.e. no charging, no development, no exposure, and no first transfer. On the first subsequent rotation, i.e. "pass" of the photoreceptor, the photoreceptor is then charged normally, but with the transfer device, the ROS exposure, the erase, and development (biasing such that we minimize development onto the P/R) turned off. On subsequent revolutions, the charge device is also turned off. By measuring the potential on the surface of the photoreceptor after an initial erase cycle, the effects of depletion will impact the measured voltages for the first couple of revolutions. A flowchart illustrating the required sequence of operations is provided in FIG. 4.

Initially, the process begins 405.

Next 410, all subsystems except erase are turned off.

Next 415, the P/R belt/drum is erased for a single revolution.

Next 420, the charging device is turned on while all other subsystems are off.

Next 425, the P/R belt/drum is charged for a single revolution with all other subsystems off.

Next 430, charging is turned off.

Next 435, $V_{opc}$ decay behavior is measured for several revolutions.

Next 440, all subsystems are returned to their nominal operating modes and the process ends 445.

By comparing this set of measurements to those obtained by measuring the contribution from dark-decay as discussed above, it is then possible to isolate the impact of depletion. A number of techniques can be used to quantify the effects of depletion based on this data. For example, the linear slope between the first two data points can be measured, i.e. the measured $V_{opc}$ for the first two P/R revolutions after charging, for both the dark-decay ($\beta_{dark}$) and depletion ($\beta_{depletion}$) test modes. These slopes can then be used to facilitate a number of useful analyses as discussed below.

The data obtained from the decay measurements presented above can be used for a number of purposes. First, the measurements of the dark decay parameters, i.e. the decay slope $\alpha$, and the initial decay slopes, i.e. $\beta_{dark}$ and $\beta_{depletion}$, can be used as a means of quantifying the "health state" of the photoreceptor. This can be accomplished in a number of ways. A few examples are provided below as illustrations:

These parameters can be compared to those measured for a nominal P/R. The differences between the current measurements of the P/R parameters and those for a new P/R can be used to quantify a health state metric in the following fashion:

$$M_{PR}=\phi_1(\alpha_{nom}-\alpha)^2+\phi_2(\beta_{dep}^{nom}-\beta_{dep})^2+\phi_3(\beta_{dark}^{nom}-\beta_{dark})^2$$

where the coefficients ($\phi_i$) would be determined based on offline experiments for a given class of P/R material and print engine.

A set of threshold values can be determined experimentally which indicate failure onset for the P/R material. The distance from the measured P/R parameters to those for the failure condition can be used to quantify the health state of the P/R in the following fashion:

$$M_{PR}=\phi_1(\alpha_{fail}-\alpha)^2+\phi_2(\beta_{dep}^{fail}-\beta_{dep})^2+\phi_3(\beta_{dark}^{fail}-\beta_{dark})^2$$

where the coefficients ($\phi_i$) can be determined based on offline experiments for a given class of P/R material and print engine.

By tracking the evolution of these fit parameters over time, trends and/or large changes in behavior can be identified. Either of these can be used as key indicators that the P/R material is changing in undesirable ways.

The ratio of the dark-decay ($\beta_{dark}$) and depletion ($\beta_{depletion}$) initial decay slopes can also be used as a simple measure of the degree to which depletion is playing a dominant role in the P/R behavior. Changes in this ratio can be indicative of undesirable changes in P/R characteristics.

The health state information that is made possible through the presently disclosed methodology enables a number of important capabilities. First, this type of information can be used to weight the probabilities in a Bayesian type diagnostic engine. For example, if the measured health state of the P/R indicates that problems are more likely, then the prior probability for the P/R being the source of a given customer observed failure could be increased. This is akin to what would more traditionally be done based on the measured age of the P/R, i.e. number of cycles since installation. In both cases, something about the measured state of the P/R is being used to inform the likelihood of it being the source of a known failure.

Another use for the health state information is in creating remaining useful life (RUL) metrics. The ability to project RUL for a component enables scheduled maintenance and can reduce both part and service costs. Without the ability to accurately measure the health state of the components in the system, it is not possible to create useful RUL metrics. This disclosure provides a general methodology for decoupling the intrinsic P/R behaviors from those of the charge device. Clearly this is a necessity for creating RUL prediction capabilities for the P/R.

In addition to being useful in determining health state information, the presently disclosed methodology and exemplary embodiments thereof can also be used to inform machine diagnostics. More specifically, field service technicians currently use the NVM based health state rule described earlier by detecting a large difference between the applied $V_{grid}$ in the scorotron and the measured $V_{opc}$ to indicate a problem with either the charge device or the photoreceptor. This disclosure provides the capability for resolving this ambiguity through the following procedure:

The dark decay response of the photoreceptor is measured at the time of installation. This defines the "nominal" behavior of the P/R. The nominal dark decay behavior for a given type of P/R can also be characterized through offline laboratory experiments and stored in the memory of the printer during manufacturing. During a subsequent diagnostic mode, the dark decay response of the P/R is re-measured using the method provided. If the dark decay rate (a) is substantially different from that for a new P/R, then the photoreceptor is likely the cause of the observed difference between $V_{grid}$ and $V_{opc}$. A set of sample dark decay curves for different failure mode conditions is given in FIG. 5.

Figure 5:
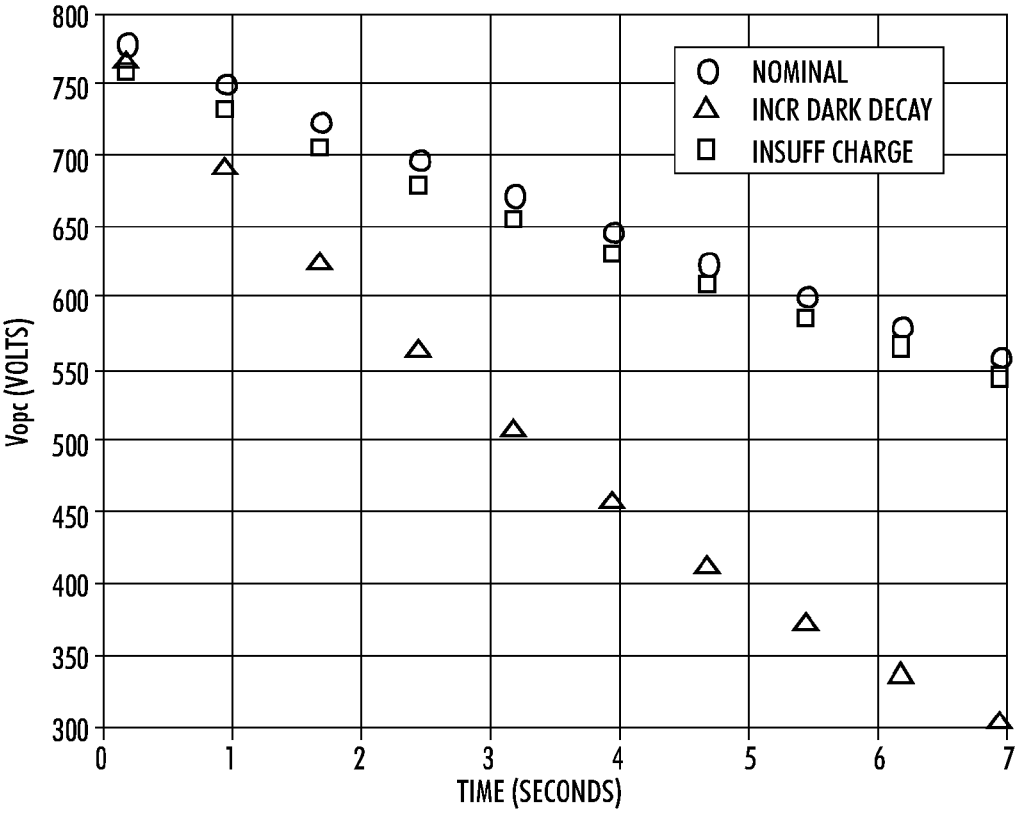
FIG. 5 is a graph of a P/R behavior using multi-pass measurements under different conditions according to an exemplary embodiment of this disclosure.

The graph in FIG. 5 shows measurements of the decay of potential of a photoreceptor under several conditions. In the case when the photoreceptor is in good condition, but the charging station is unable to bring the photoreceptor to the required potential, the dark decay substantially proceeds as in the case of a nominal photoreceptor, but at a lower value of potential. Also, in this case, the potential even at zero time will be lower than the nominal value. In other words, the dark decay curve in the case of a defective charging station is substantially parallel to that of the nominal case, but lower in potential. This condition is illustrated by the squares in FIG. 5. In the case where the photoreceptor is not operating in a nominal manner and has a much higher rate of dark decay, the potential will degrade more rapidly and the dark decay curve will not parallel the nominal case. This is illustrated by the triangles in FIG. 5.

If the dark-decay rate is within bounds, then the initial depletion slope, or the ratio of the initial depletion slope to the initial dark decay slope, can be examined. If this is substantially different from that observed for a new P/R, then the photoreceptor is once again likely the cause of the observed difference between $V_{grid}$ and $V_{opc}$.

If neither of these two conditions is met, then the charge device, not the photoreceptor, is likely the cause of the observed difference between $V_{grid}$ and $V_{opc}$.

Variations on these methods are also possible. The key is that the disclosed methods and systems provide a key capability for helping to isolate the contributions from the charge device and the photoreceptor to measured/observed behavior.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of performing diagnostics on a xerographic printing system to determine a failure mode associated with the xerographic printing system, the printing system including a photoreceptor surface, a charging station, a light exposure station, a developer station, an image transfer station, an eraser station, and photoreceptor surface voltage sensor, the method comprising:

a) the charging station charging the photoreceptor surface for two or more revolutions while the light exposure station, the developer station and eraser station are in a state which does not substantially affect the charge state of the photoreceptor surface;

b) stopping the charging of the photoreceptor surface and allowing the photoreceptor surface to revolve while monitoring the voltage of the photoreceptor surface;

c) the charging station charging the photoreceptor for a single revolution after the voltage of the photoreceptor surface decays to $V_{residual}$;

d) monitoring the voltage of the photoreceptor for two or more revolutions to determine the $V_{opc}$ decay behavior of the photoreceptor surface without depletion;

e) erasing the photoreceptor surface for one revolution while the charging station, the light exposure station and the developer station are in a state which does not substantially affect the charge state of the photoreceptor surface;

f) charging the photoreceptor surface for one revolution while the light exposure station, the developer station and the erase station are in a state which does not substantially affect the charge state of the photoreceptor surface;

g) monitoring the voltage of the photoreceptor for two or more revolutions to determine $V_{opc}$ decay behavior of the photoreceptor surface with depletion;

h) comparing the $V_{opc}$ decay behavior determined in step d) with the $V_{opc}$ decay behavior determined in step g) and determining the performance state of one or more of the charging station and the photoreceptor surface based on the comparison; and i) performing one or more of communicating and storing the performance state of one or more of the charger and the photoreceptor surface.

2. The method of performing diagnostics on a xerographic printing system according to claim 1, wherein the ESV monitor is one of an ESV and a BTR.

3. The method of performing diagnostics on a xerographic printing system according to claim 1, step h) comprising:

comparing the $V_{opc}$ decay behavior in step d) without depletion to a $V_{opc}$ nominal decay behavior and the $V_{opc}$ decay behavior in step g) with depletion.

4. The method of performing diagnostics on a xerographic printing system according to claim 3, wherein the performance state is one of a failed photoreceptor surface and a failed charging station.

5. The method of performing diagnostics on a xerographic printing system according to claim 4, wherein a failed photoreceptor surface is determined if the $V_{opc}$ decay behavior in step d) without depletion decays more rapidly than $V_{opc}$ nominal decay behavior.

6. The method of performing diagnostics on a xerographic printing system according to claim 4, wherein a failed photoreceptor surface is determined if the $V_{opc}$ decay behavior in step d) without depletion decays substantially consistent with $V_{opc}$ nominal decay behavior, and the $V_{opc}$ decay behavior in step g) with depletion includes a photoreceptor initial voltage substantially lower than a photoreceptor initial voltage associated with the $V_{opc}$ nominal decay behavior.

7. The method of performing diagnostics on a xerographic printing system according to claim 4, wherein a failed charging station is determined if the $V_{opc}$ decay behavior in step d) without depletion includes a photoreceptor initial voltage substantially lower than a photoreceptor initial voltage associated with the $V_{opc}$ nominal decay behavior, and the $V_{opc}$ decay behavior in step g) with depletion includes a photoreceptor initial voltage substantially lower than a photoreceptor initial voltage associated with the $V_{opc}$ nominal decay behavior and substantially equivalent to the photoreceptor initial voltage associated with the $V_{opc}$ decay behavior in step d) without depletion.

8. The method of performing diagnostic on a xerographic printing system according to claim 1, wherein the photoreceptor surface is a photoreceptor drum.

9. A xerographic printing system comprising:

a photoreceptor surface;

a charging station;

a light exposure station;

a developer station;

an image transfer station;

a photoreceptor surface voltage sensor; and a controller operatively associated with the photoreceptor surface, charging station, light exposure station, image transfer station and photoreceptor surface voltage sensor, the controller configured to perform the method comprising:

a) the charging station charging the photoreceptor surface for two or more revolutions while the light exposure station, the developer station and eraser station are in a state which does not substantially affect the charge state of the photoreceptor surface;

b) stopping the charging of the photoreceptor surface and allowing the photoreceptor surface to revolve while monitoring the voltage of the photoreceptor surface;

c) the charging station charging the photoreceptor for a single revolution after the voltage of the photoreceptor surface decays to $V_{residual}$;

d) monitoring the voltage of the photoreceptor for two or more revolutions to determine the $V_{opc}$ decay behavior of the photoreceptor surface without depletion;

e) erasing the photoreceptor surface for one revolution while the charging station, the light exposure station and the developer station are in a state which does not substantially affect the charge state of the photoreceptor surface;

f) charging the photoreceptor surface for one revolution while the light exposure station, the developer station and the erase station are in a state which does not substantially affect the charge state of the photoreceptor surface;

g) monitoring the voltage of the photoreceptor for two or more revolutions to determine $V_{opc}$ decay behavior of the photoreceptor surface with depletion;

h) comparing the $V_{opc}$ decay behavior determined in step d) with the $V_{opc}$ decay behavior determined in step g) and determining the performance state of one or more of the charging station and the photoreceptor surface based on the comparison; and i) performing one or more of communicating and storing the performance state of one or more of the charger and the photoreceptor surface.

10. The xerographic printing system according to claim 9, wherein the ESV monitor is one of an ESV and a BTR.

11. The xerographic printing system according to claim 9, step h) comprising:

comparing the $V_{opc}$ decay behavior in step d) without depletion to a $V_{opc}$ nominal decay behavior and the $V_{opc}$ decay behavior in step g) with depletion.

12. The xerographic printing system according to claim 11, wherein the performance state is one of a failed photoreceptor surface and a failed charging station.

13. The xerographic printing system according to claim 12, wherein the performance state is one of a failed photoreceptor surface and a failed charging station.

14. The xerographic printing system according to claim 12, wherein a failed photoreceptor surface is determined if the $V_{opc}$ decay behavior in step d) without depletion decays more rapidly than $V_{opc}$ nominal decay behavior.

15. The xerographic printing system according to claim 12, wherein a failed photoreceptor surface is determined if the $V_{opc}$ decay behavior in step d) without depletion decays substantially consistent with $V_{opc}$ nominal decay behavior, and the $V_{opc}$ decay behavior in step g) with depletion includes a photoreceptor initial voltage substantially lower than a photoreceptor initial voltage associated with the $V_{opc}$ nominal decay behavior.

16. The xerographic printing system according to claim 12, wherein a failed charging station is determined if the $V_{opc}$ decay behavior in step d) without depletion includes a photoreceptor initial voltage substantially lower than a photoreceptor initial voltage associated with the $V_{opc}$ nominal decay behavior, and the $V_{opc}$ decay behavior in step g) with depletion includes a photoreceptor initial voltage substantially lower than a photoreceptor initial voltage associated with the $V_{opc}$ nominal decay behavior and substantially equivalent to the photoreceptor initial voltage associated with the $V_{opc}$ decay behavior in step d) without depletion.

17. The xerographic printing system according to claim 9, wherein the photoreceptor surface is a photoreceptor drum.

18. A method of performing diagnostics on a xerographic printing system in a diagnostic mode, independent from a nominal printing mode, to determine a failure mode associated with the xerographic printing system, the printing system including a photoreceptor surface, a charging station, a light exposure station, a developer station, an image transfer station, an eraser station, and photoreceptor surface voltage sensor, the method comprising:

the xerographic printing system running in diagnostic mode and executing the method comprising:

a) the charging station charging the photoreceptor surface for two or more revolutions while the light exposure station, the developer station and eraser station are in a state which does not substantially affect the charge state of the photoreceptor surface;

b) stopping the charging of the photoreceptor surface and allowing the photoreceptor surface to revolve while monitoring the voltage of the photoreceptor surface;

c) the charging station charging the photoreceptor for a single revolution after the voltage of the photoreceptor surface decays to $V_{residual}$;

d) monitoring the voltage of the photoreceptor for two or more revolutions to determine the $V_{opc}$ decay behavior of the photoreceptor surface without depletion;

e) erasing the photoreceptor surface for one revolution while the charging station, the light exposure station and the developer station are in a state which does not substantially affect the charge state of the photoreceptor surface;

f) charging the photoreceptor surface for one revolution while the light exposure station, the developer station and the erase station are in a state which does not substantially affect the charge state of the photoreceptor surface;

g) monitoring the voltage of the photoreceptor for two or more revolutions to determine $V_{opc}$ decay behavior of the photoreceptor surface with depletion;

h) comparing the $V_{opc}$ decay behavior determined in step d) with the $V_{opc}$ decay behavior determined in step g) and determining the performance state of one or more of the charging station and the photoreceptor surface based on the comparison; and i) performing one or more of communicating and storing the performance state of one or more of the charger and the photoreceptor surface; and the xerographic printing system exiting the diagnostic mode.

19. The method of performing diagnostics on a xerographic printing system according to claim 18, step h) comprising:

comparing the $V_{opc}$ decay behavior in step d) without depletion to a $V_{opc}$ nominal decay behavior and the $V_{opc}$ decay behavior in step g) with depletion.

20. The method of performing diagnostics on a xerographic printing system according to claim 19, wherein the performance state is one of a failed photoreceptor surface and a filed charging station.

* * * * *